US006386916B1

(12) United States Patent
Tachi et al.

(10) Patent No.: US 6,386,916 B1
(45) Date of Patent: May 14, 2002

(54) CONNECTOR

(75) Inventors: Hideshi Tachi; Kiyofumi Ichida, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/672,451

(22) Filed: Sep. 29, 2000

(30) Foreign Application Priority Data

Oct. 5, 1999 (JP) ..... 11-284082

(51) Int. Cl.[7] ..... H01R 13/40
(52) U.S. Cl. ..... 439/595; 439/752
(58) Field of Search ..... 439/595, 744, 439/752

(56) References Cited

U.S. PATENT DOCUMENTS 4,998,896 A * 3/1991 Lundergan ..... 439/595
5,860,835 A * 1/1999 Ohsumi ..... 439/595
6,159,047 A * 12/2000 Tanaka ..... 439/595

FOREIGN PATENT DOCUMENTS

JP 3-55674 5/1991

* cited by examiner

*Primary Examiner*—Tho D. Ta
*Assistant Examiner*—Felix O. Figueroa
(74) *Attorney, Agent, or Firm*—Banner & Witcoff, Ltd.

(57) ABSTRACT

The invention prevents terminal fittings from vibrating within cavities. Female terminal fittings (15) are inserted into cavities (13), these female terminal fittings (15) being retained by lances (23). Next, a retainer (30) is attached to an anterior end of a terminal housing (11), regulating members (33) thereof entering bending spaces (26), thereby regulating the bending of the lances (23) and doubly retaining the female terminal fittings (15). Simultaneously, base member contacting members (37) formed on the regulating members (33) enter opening grooves (28) in base walls of the cavities (13) and press base faces of connecting members (16) of the female terminal fittings (15) upwards. These connecting members (16) are gripped between the base member contacting members (37) and ceiling faces of the cavities (13). In addition, anterior contacting members (38) make contact with anterior faces of the connecting members (16) and push the female terminal fittings (15) back towards the posterior. Stopped ends (16A) at posterior ends of the connecting members (16) are pushed against stopping faces (24A) of protrusions (24) of the lances (23), thereby filling a clearance. Rubbing between resilient contacting members (17) and tabs (45) of male terminal fittings is thereby prevented.

12 Claims, 5 Drawing Sheets

CONNECTOR

TECHNICAL FIELD

The present invention relates to an electrical connector having a configuration whereby terminal fittings inserted into cavities of a connector housing are retained therein by lances.

BACKGROUND TO THE INVENTION

As shown in FIG. 10 of this specification, a conventional connector is configured to have cavities 2 provided within a female housing 1. Female terminal fittings 3 are inserted into these cavities 2 and are housed unremovably therein by respective lances 4. Male terminal fittings 6 are inserted into cavities 2 provided within a male housing 5 and are housed unremovably therein by respective lances 4. The corresponding male and female terminal fittings 6 and 3 make contact when the two housings 1 and 5 are fitted together.

The configuration for housing the terminal fittings in the cavities in an unremovable state may be examined in more detail in the female housing 1 shown in FIG. 11. Protrusions 7 are provided on upper faces of the lances 4. These lances 4 have a cantilevered shape, are capable of bending, and are provided in a unified manner with base faces of the cavities 2. The lances 4 are bent while the female terminal fittings 3 are inserted into the cavities 2, these female terminal fittings 3 being inserted to a prescribed position. Then the lances 4 return to their original position and the protrusions 7 fit into base face openings 8 of the female terminal fittings 3, thereby housing them in an unremovable state.

The male housing 5 has the same configuration. Furthermore, a configuration of this type which uses lances to retain terminal fittings is described in JP 3-55674.

In the above example, the cantilevered lances 4 constitutes the retaining configuration. These lances 4 are capable of bending with a base end as their pivot centre. As a result, a prescribed clearance is required between the protrusions 7 of the lances 4 and stopped edges 8A of the openings 8. Consequently there is the problem that if a pushing or pulling force is exerted on electric wires 9, the terminal fittings 3 vibrate in the anterior-posterior direction within the cavities 2, and contacting members of the female and male terminal fittings 3 and 6 repeatedly rub against one another. These contacting members gradually become abraded, and their contacting force decreases. The present invention has taken the above problem into account, and aims to present a connector wherein the terminal fittings are prevented from vibrating within the cavities, thereby preventing rubbing and abrasion of these terminal fittings.

SUMMARY OF THE INVENTION

According to the invention there is provided an electrical connector comprising an electrical connector comprising a housing having a cavity formed therein, an elongate terminal fitting inserted in the cavity in a fitting direction, and a retainer engageable in the housing to retain the fitting in the cavity, characterised in that said retainer includes an abutment engageable with an adjacent end of said fitting for pushing said fitting against said fitting direction, and said retainer further includes a protrusion extending perpendicularly to said fitting direction and engageable with one side of said fitting for pushing said fitting against a side wall of said cavity.

Preferably the housing further includes a resiliently bendable lance for engaging and retaining the terminal in the cavity, said retainer being engageable in a direction opposite to said fitting direction, and for preventing bending of said lance, and said abutment pushing said fitting into contact with said lance.

Preferably the abutment and protrusion are on the same side of the retainer and to one side of an insertion aperture of a corresponding terminal fitting. The retainer is preferably a front retainer adapted in use to be between mating connector housings.

The cavities may include built-up members at the innermost ends in order to grip the adjacent ends of the terminal fittings tightly. This arrangement minimizes vibration of the fittings without substantially increasing insertion resistance.

BRIEF DESCRIPTION OF DRAWINGS

Other features of the invention will be apparent form the following description of a preferred embodiment shown by way of example only in the accompanying drawings in which.

DESCRIPTION OF PREFERRED EMBODIMENT

An embodiment of the present invention is described below with the aid of FIGS. 1 to 9. In the present embodiment, a female connector is described.

Figure 1:
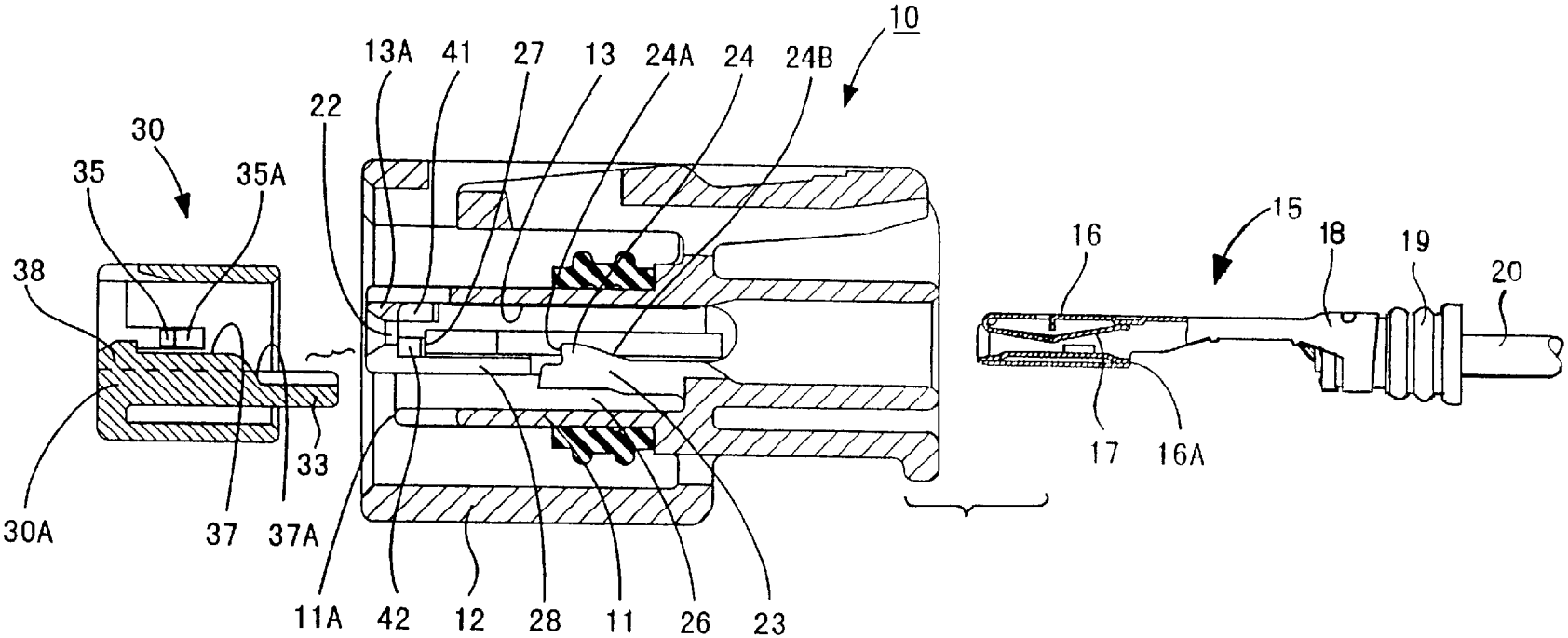
FIG. 1 is a cross-sectional view showing a female connector of an embodiment of the present invention in a state prior to being attached.
Figure 2:
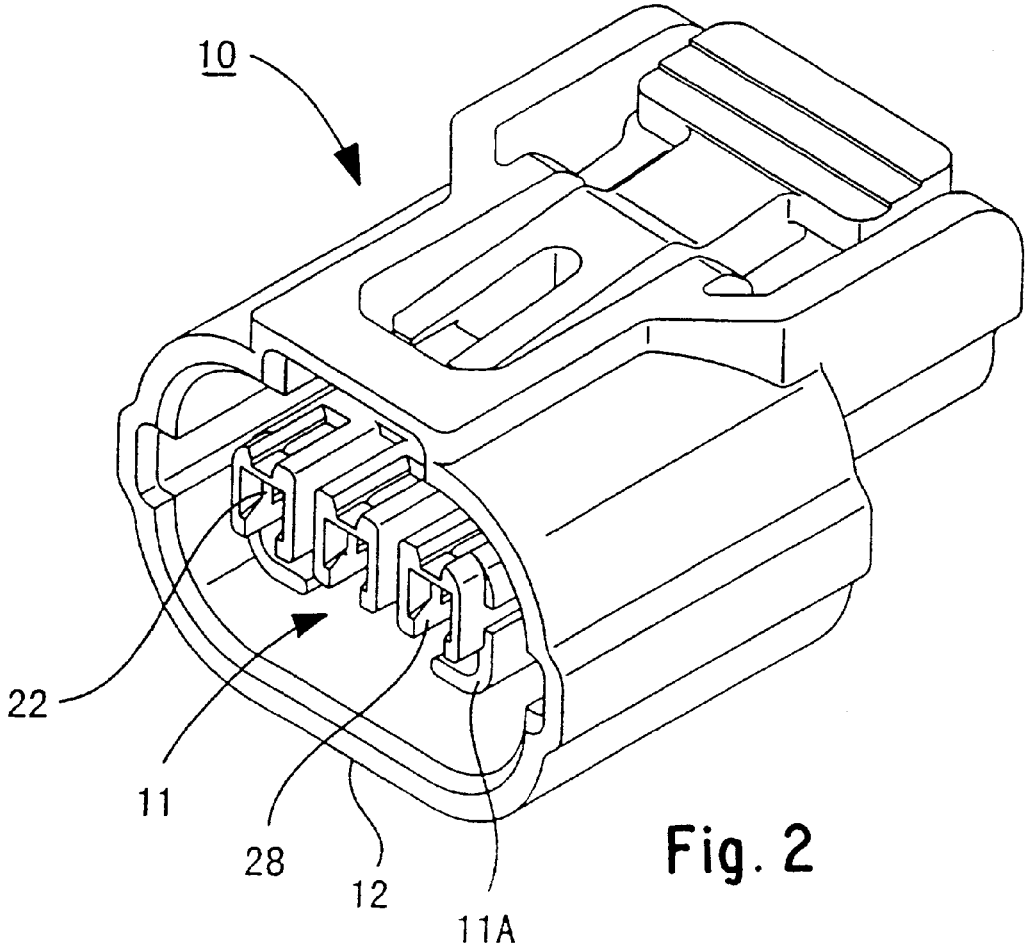
FIG. 2 is a diagonal view of a female housing.

In FIGS. 1 and 2, the number 10 refers to a female connector housing made from plastic, and having a terminal housing 11 which is approximately planar. A hood 12 is fitted around an anterior half of the terminal housing 11. Cavities 13 (three are shown) are horizontally aligned within the terminal housing 11. A lower portion of an anterior face of the terminal housing 11 is slightly concave, and an anterior side thereof is divided so as to keep each cavity 13 separate.

A female terminal fitting 15 is housed within each cavity 13. Each female terminal fitting 15 is formed by pressing from highly conductive sheet metal. An anterior end of the terminal fitting 15 forms an angular tubular connecting member 16 which has a resilient contacting member 17 provided therein. A posterior end of the terminal fitting 15 is provided with a barrel 18. This barrel 18 is clamped to a waterproof rubber stopper 19 and an electric wire 20. A posterior end of a lower face of the connecting member 16 forms a stopped end 16A.

Figure 9:
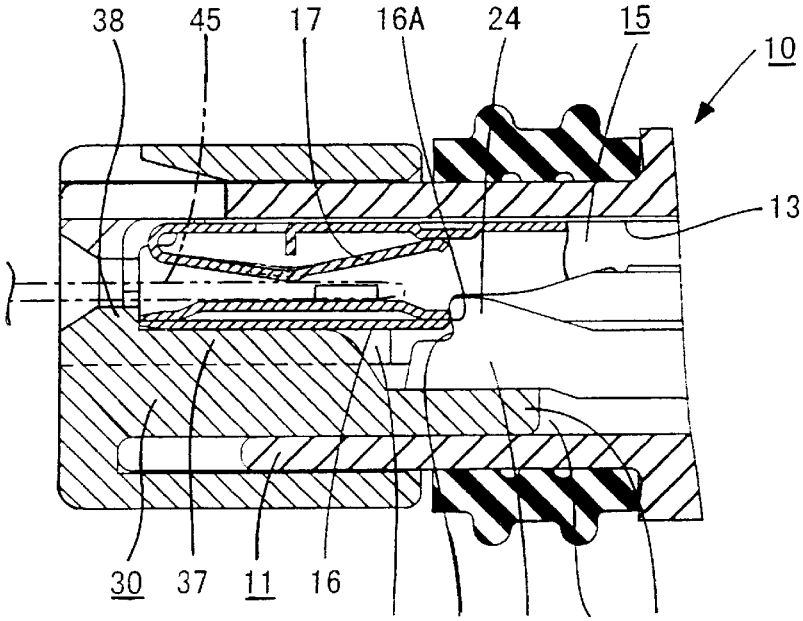
FIG. 9 is a partial cross-sectional view showing the retainer in an attached state.
Figure 10:
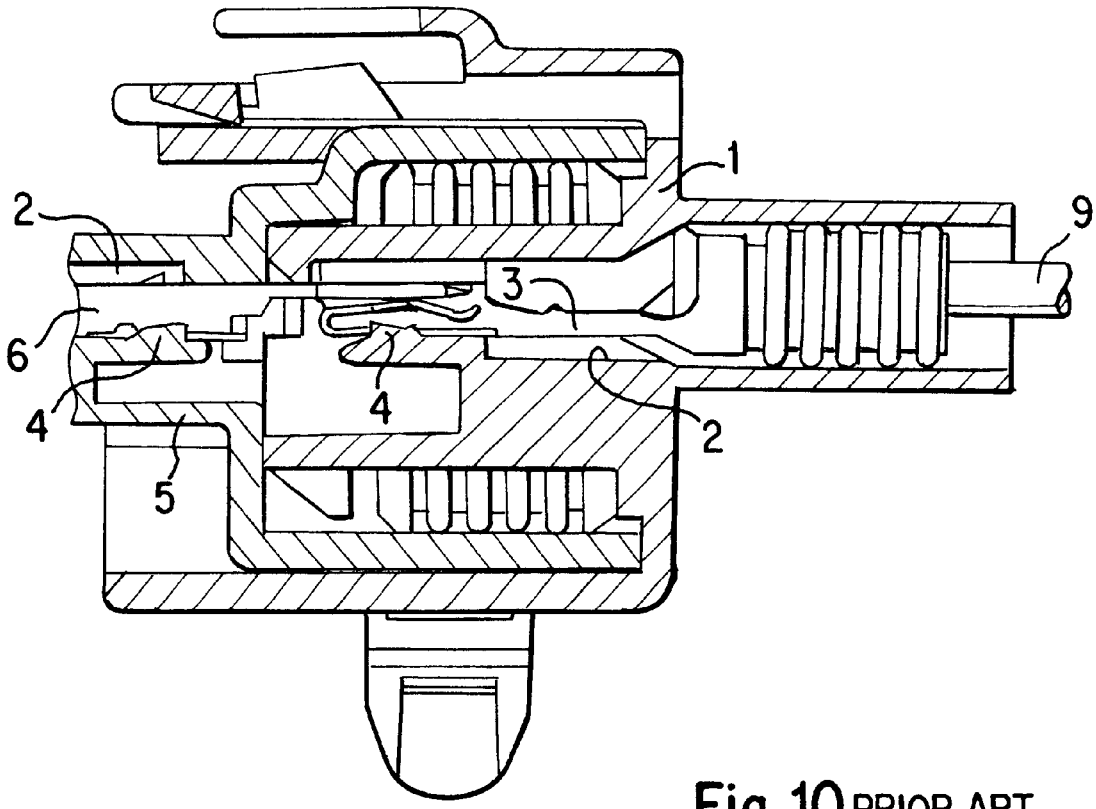
Fig.10 PRIOR ART
FIG. 10 is a cross-sectional view of a prior art example.
Figure 11:
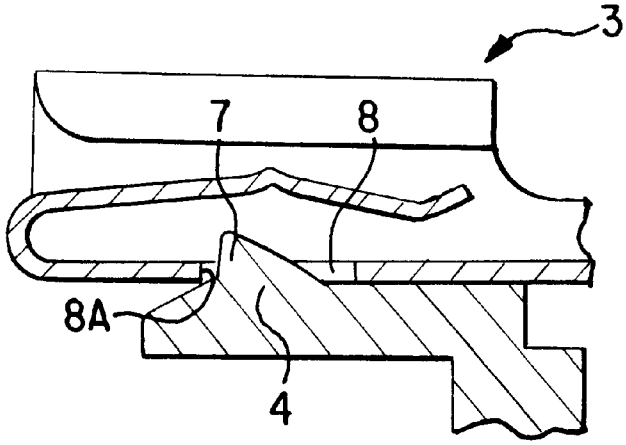
Fig.11 PRIOR ART
FIG. 11 is an expanded view of a portion of the prior art example.

A terminal insertion hole 22 formed in an anterior wall 13A of each cavity 13 allows a tab 45 of a corresponding male terminal fitting to be inserted therein (see FIG. 9). A lance 23 is formed in a unified manner on a base face of each cavity 13. This lance 23 extends towards the anterior in a cantilevered shape, a protrusion 24 being formed on an upper face of this lance 23 at a location in the vicinity of the extending end thereof. This protrusion 24 engages with a posterior end of the stopped end 16A of the female terminal fitting 15. As shown in detail in FIG. 6, an anterior face of the protrusion 24 forms a stopping face 24A which is cut away almost perpendicularly, and a posterior face of the protrusion 24 forms a guiding face 24B which is inclined downwards towards the posterior.

The lance 23 can be bent downwards towards a bending space 26 below the extending end of this lance 23, and an opening groove 28 is provided in a base wall of the cavity 13 at a location to the anterior of the lance 23. A jig can be inserted through this opening groove 28 to bend the lance 23 into the bending space 26 and thereby release its engagement.

The terminal fittings 15 are inserted from the posterior into the cavities 13 to a location where the anterior ends thereof make contact with the anterior walls 13A of the cavities 13. Then the stopped ends 16A at the posterior ends of the connecting members 16 pass the stopping faces 24A of the protrusions 24 of the lances 23.

Figure 4:
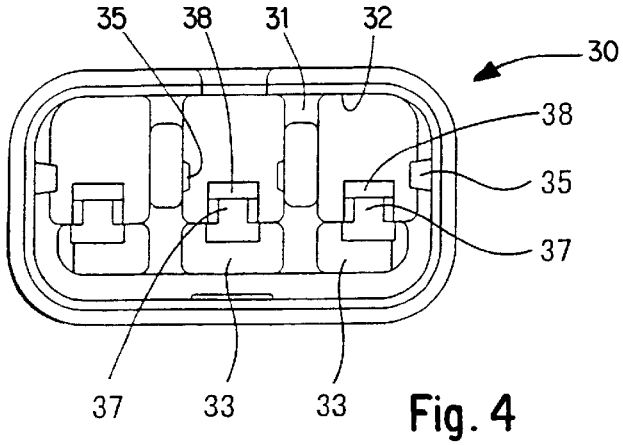
FIG. 4 is a rear face view of a retainer.
Figure 5:
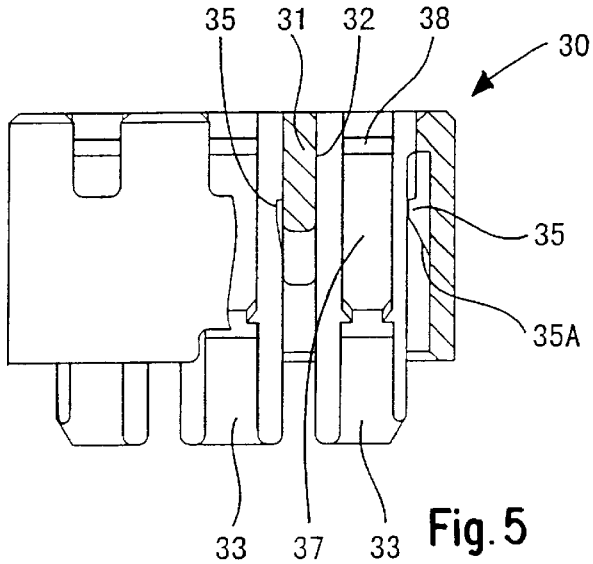
FIG. 5 is a partially cut-away plan view of the retainer.

A front retainer 30 attached at the anterior end of the terminal housing 11 doubly retains the female terminal fittings 15 in an unremovable state. As shown in FIGS. 4 and 5, this front retainer 30 is formed in a rectangular cap-shape so as to cover the circumference of the anterior end portion of the terminal housing 11. Slightly more than the upper half of an anterior face thereof is open and is divided by dividing walls 31, thereby forming three window holes 32 which are horizontally aligned and which correspond to the cavities 13 of the terminal housing 11. The two dividing walls 31 can be inserted relatively tightly into spaces between portions dividing the terminal housing 11. Regulating members 33 protrude downwards from the lower portion of the retainer 30. These regulating members 33 enter the bending spaces 26 of the lances 23 provided in the cavities 13, and prevent the bending of these lances 23.

As shown in FIG. 5, the means to lock the retainer 30 to the terminal housing 11 consists of long and narrow protruding members 35 which protrude in an anterior-posterior direction from inner faces of left and right side walls of the retainer 30, and from both opposing faces of the dividing walls 31. An anterior side, relative to the direction of attaching of the retainer 30 (the right side in FIG. 1), of each protruding member 35 forms a tapered guiding face 35A.

Figure 3:
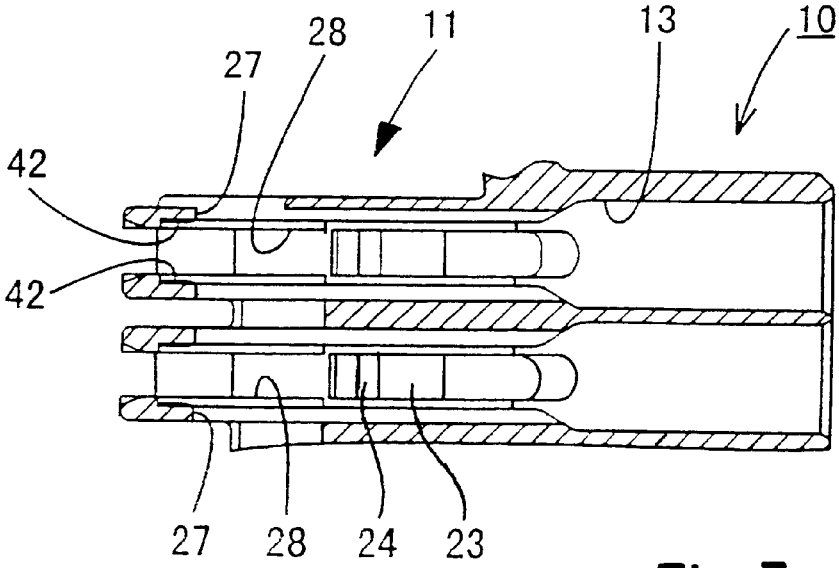
FIG. 3 is a plan cross-sectional view of a terminal housing.

As shown in FIG. 3, stopping holes 27 are formed on outer sides of side walls of the left and right side cavities 13 and on left and right side walls of the central cavity 13.

The protruding members 35 fit with these stopping holes 27. When the retainer 30 is to fit with the terminal housing 11, an innermost face of an anterior wall 30A is pushed in until it makes contact with an anterior edge 11A of a lower face of the terminal housing 11, the protruding members 35 fitting with the corresponding stopping holes 27.

A base member contacting member 37 is formed on an upper face of each regulating member 33 at a central location in a width-wise direction, each base member contacting member 37 extending from an anterior end (the left side in FIG. 1) of the upper face to a location slightly beyond the centre thereof. The base member contacting members 37 rise to a specified height, and are capable of being inserted into the opening grooves 28 in the base walls of the cavities 13. The height of the base member contacting members 37 is such that, when the retainer 30 is in a correctly attached state, the space between an upper face of each base member contacting member 37 and a ceiling face of the cavity 13 is slightly smaller than the vertical dimensions of the connecting member 16 of the female terminal fitting 15. A posterior end of each base member contacting member 37 forms an inclined face 37A.

An anterior contacting member 38 protrudes upwards from an anterior end of each base member contacting member 37. When the retainer 30 is correctly attached, these anterior contacting members 38 make contact with an anterior face of the connecting member 16 of the female terminal fitting 15, and are pushed in, from the posterior, for a specified distance. The distance that they are pushed in (explained in more detail below) is sufficient to fill a clearance C which corresponds to the space between the protrusions 24 of the lances 23 and the stopped ends 16A.

Figure 6:
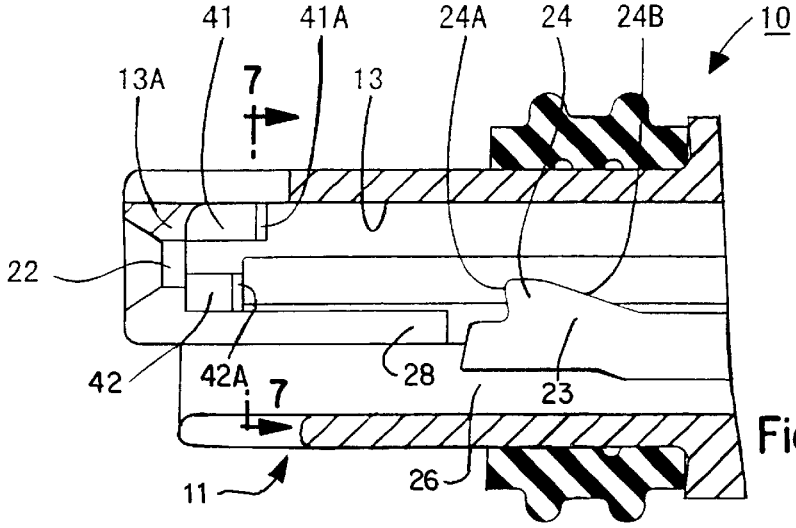
FIG. 6 is a partial cross-sectional view of the configuration of the interior of the terminal housing.
Figure 7:
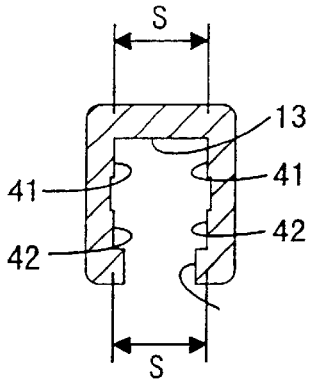
FIG. 7 is a side face view of FIG. 6 along the line 7—7.

The space between the left and right side walls of each cavity 13 is somewhat wider than the width of the connecting members 16 of the female terminal fittings 15. As shown in FIGS. 6 and 7, upper built-up members 41 and lower built-up members 42 protrude at upper and lower locations from anterior ends of inner faces of the left and right side walls of the cavities 13. The upper built-up members 41 are slightly longer in an anterior-posterior direction than the lower built-up members 42. Spaces S between these mutually opposing upper built-up members 41 and lower built-up members 42 are slightly narrower than the width of the connecting members 16 of the female terminal fittings 15. Posterior ends of the two built-up members 41 and 42 form tapered faces 41A and 42A.

Next, the operation of the present embodiment is explained. As shown in FIG. 1, the female terminal fittings 15 (to which the electric wires 20 have been attached) are inserted from the posterior into the cavities 13 of the female housing 10. As this insertion progresses, anterior faces of the connecting members 16 make contact with the guiding faces 24B of the protrusions 24 of the lances 23 and these lances 23 are bent towards the bending spaces 26. As the insertion operation reaches its final stages, the anterior ends of the connecting members 16 are pushed between and gripped by the mutually opposing built-up members 41 and 42, and are pushed in until they are halted by making contact with the anterior walls 13A.

Figure 8:
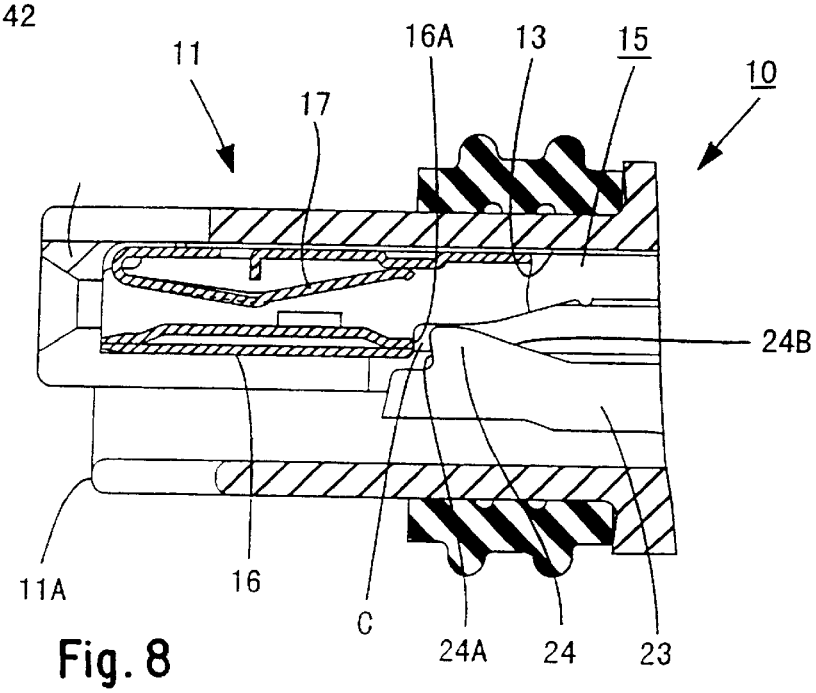
FIG. 8 is a partial cross-sectional view showing a state whereby the insertion of female terminal fittings has been completed.

At this juncture, the stopped ends 16A of the female terminal fittings 15 pass the location of the stopping faces 24A of the protrusions 24. Consequently, as shown in FIG. 8, the lances 23 return to their original position and the protrusions 24 fit with the posterior portion of the stopped ends 16A. The clearance C is formed in the space between the stopping faces 24A of the protrusions 24 of the lances 23 and the stopped ends 16A of the female terminal fittings 15.

After all the female terminal fittings 15 have been inserted, the retainer 30 is attached to the anterior end of the terminal housing 11. As the retainer 30 is pushed in, the protruding members 35 rise over the outer face of the walls on which the stopping holes 27 are formed. The retainer 30 is pushed in until it makes contact with the anterior edge 11A of the lower face of the terminal housing 11. Next, the protruding members 35 fit into the corresponding stopping holes 27, thereby locking the retainer 30.

Simultaneously, as shown in FIG. 9 the regulating members 33 enter the bending spaces 26 of the lances 23 and prevent undesired bending of these lances 23, thereby doubly retaining the female terminal fittings 15 in an unremovable state.

Moreover, the base member contacting members 37 provided on the regulating members 33 are inserted into the opening grooves 28 in the base walls of the cavities 13, and push the base faces of the connecting members 16 of the female terminal fittings 15 upwards. The connecting members 16 are then gripped between the base member contacting members 37 and the ceiling faces of the cavities 13. In addition, the anterior contacting members 38 make contact with the anterior faces of the connecting members 16 and push the female terminal fittings 15 back towards the posterior. The stopped ends 16A at the posterior ends of the connecting members 16 are pushed against the stopping faces 24A of the protrusions 24 of the lances 23, thereby filling the clearance C.

After the attachment of the female connector is completed as described above, it is fitted to a male connector protruding from, for example, a machine. As shown by the chain line in FIG. 9, tabs 45 of the corresponding male terminal fittings are inserted into the connecting members 16 of the female terminal fittings 15 and make contact with the resilient contacting members 17.

At this juncture, even if a pushing or a pulling force is exerted on the electric wires 20 of, for example, the female connector, the stopped ends 16A of the female terminal fittings 15 are pushed by the protrusions 24 of the lances 23. Consequently, the female terminal fittings 15 do not rattle in an anterior-posterior direction within the cavities 13. As a result, the resilient contact members 17 and the tabs 45 of the male terminal fittings are prevented from scraping against one another.

Furthermore, the connecting members 16 of the female terminal fittings 15 are gripped in the up-down direction between the base member contacting members 37 of the retainer 30 and the ceiling faces of the cavities 13. In the left-right direction, these connecting members 16 are gripped between the mutually opposing built-up members 41 and 42. That is, the female terminal fittings 15 are housed within the cavities 13 in a manner whereby they do not rattle in any direction.

In this manner, friction between the points of contact of the female and male terminal fittings 15 and 45 is prevented, and a state which has a good contacting force is maintained over a long period.

The retainer 30 forms a cap shape which covers the anterior end of the terminal housing 11. Consequently, the position of the retainer can easily be fixed in the up-down and left-right directions, thereby preventing rattling.

Moreover, a resisting force is exerted when the connecting members 16 of the female terminal fittings 15 are pushed between the mutually opposing built-up members 41 and 42. However, these built-up members 41 and 42 are located only at the anterior end of the cavities 13, and this resistance appears only in the final stages of the pushing-in operation. Consequently, this resistance is kept to a minimum.

The present invention is not limited to the embodiments described above with the aid of figures. For example, the possibilities described below also lie within the technical range of the present invention. In addition, the present invention may be embodied in various other ways without deviating from the scope thereof.

(1) A front retainer has been described in the present embodiment. However, it is equally suitable to use another type of retainer, provided that this retainer has the function of pushing the terminal fittings back at the time of attachment.

(2) The built-up members can be provided on just one face instead of two.

(3) A female connector has been described in the present embodiment. However, the present invention is equally suitable for a male connector within male terminal fittings are retained in cavities by lances.

(4) The present invention is also suitable for use with fittings having metal lances formed thereon and engageable with protrusions of a corresponding terminal housing chamber.

What is claimed is:

1. An electrical connector comprising a housing having a cavity formed therein, an elongate terminal fitting inserted in the cavity in a fitting direction, a lock in the cavity to prevent removal of the fitting in a rearward direction opposite to the fitting direction, and a retainer that is fit into the housing to cooperate with the lock and retain the fitting in the cavity, wherein said retainer includes an abutment that engages an anterior end of said fitting and pushes said fitting in the rearward direction against the lock to grip the fitting between the lock and the retainer, and a protrusion extending perpendicularly to said fitting direction that engages one side of said fitting and pushes said fitting against a side wall of said cavity.

2. A connector according to claim 1 wherein said lock includes a resiliently bendable lance for engaging and retaining the terminal in the cavity, said retainer being engageable in a direction opposite to said fitting direction, and for preventing bending of said lance, and said abutment pushing said fitting into contact with said lance.

3. A connector according to claim 2 wherein said protrusion and said lance are on the same side of said fitting.

4. A connector according to claim 3 wherein said abutment and said lance are on the same side of said fitting.

5. A connector according to claim 2 wherein said abutment and said lance are on the same side of said fitting.

6. A connector according to claim 1 wherein said cavity has a mouth to receive said terminal fitting, and a base, the side wall of said cavity adjacent said base having an inwardly directed built-up surface to reduce the width of said cavity so as to grip a respective end of said terminal fitting.

7. A connector according to claim 6 wherein said built-up surface extends at right angles to the protrusion of said retainer.

8. A connector according to claim 7 wherein said built-up surface is provided on opposite side walls of said cavity.

9. A connector according to claim 1 and having a plurality of cavities, and a plurality of said terminals, one in each cavity.

10. A connector according to claim 9 and having a single unitary retainer with respective abutments and protrusions associated with each cavity.

11. A connector according to claim 1 wherein said abutment projects from said protrusion.

12. A connector according to claim 1 wherein said terminal fitting is adapted to receive a mating terminal in an attachment direction, and said retainer is engageable with said housing in said attachment direction.

* * * * *